United States Patent [19]

Jacobson

[11] Patent Number: 4,665,940

[45] Date of Patent: May 19, 1987

[54] CONTAINER FITTING

[75] Inventor: Charles S. Jacobson, Rockford, Ill.

[73] Assignee: Johnson Enterprises, Inc., Rockford, Ill.

[21] Appl. No.: 797,626

[22] Filed: Nov. 13, 1985

[51] Int. Cl.[4] ..... B65D 83/14

[52] U.S. Cl. ..... 137/212; 222/400.7; 137/539

[58] Field of Search ..... 137/212, 539, 535, 903; 222/400.7

[56] References Cited

U.S. PATENT DOCUMENTS

| | | | |
|---|---|---|---|
| 2,797,703 | 7/1957 | Edwards | 137/539 |
| 3,483,888 | 12/1969 | Wurzel | 137/539 |
| 4,363,336 | 12/1982 | Cerrato | 137/212 |
| 4,520,954 | 6/1985 | Brown | 222/400.8 |
| 4,573,713 | 3/1986 | Kipp | 285/319 X |

FOREIGN PATENT DOCUMENTS

| | | | |
|---|---|---|---|
| 1449198 | 7/1966 | France | 137/212 |
| 1443279 | 7/1976 | United Kingdom | 137/212 |

*Primary Examiner*—Alan Cohan

*Attorney, Agent, or Firm*—Leydig, Voit & Mayer

[57] ABSTRACT

A fitting for a container of draft beer or the like includes a first valve for permitting pressurized gas to be injected into the container and a second valve for permitting beer to be dispensed from the container. Both valves are urged to their closed positions by inexpensive elastomeric springs which also serve to hold certain components of the fitting in assembled relation. A coupler attaches the fitting to the container and enables the container to be used with Sankey-type taps.

18 Claims, 6 Drawing Figures

CONTAINER FITTING

BACKGROUND OF THE INVENTION

This invention relates generally to a container fitting and, more particularly, to a fitting for a container adapted to hold a beverage such as draft beer.

A fitting of the same general type as the present fitting is disclosed in Cerrato U.S. Pat. No. 4,363,336. The fitting of that patent is used with a beer keg and includes two valve members which are adapted to be opened when the probe of a tapping device is inserted into the fitting. Gas for pressurizing the beer flows into the keg past one of the open valve members while beer is dispensed out of the keg past the other open valve member. The valve members are urged to closed positions by two coil springs which are compressed within the fitting.

SUMMARY OF THE INVENTION

One of the aims of the present invention is to provide a new and improved fitting of the above general type which, when compared with prior fittings, is relatively inexpensive and in fact is so low in cost that it becomes feasible, if desired, to utilize the fitting as a disposable part of a disposable, nonreturn container.

A more detailed object is to achieve the foregoing in part by providing a fitting in which comparatively inexpensive elastomeric members hold certain components of the fitting together and, at the same time, serve as springs to urge the valve members to their closed positions.

Another object of the invention is to provide a fitting which enables a disposable blow molded container to be used with popular Sankey-type taps and, in addition, enables the blow molded container to be cleaned and sterilized and maintained in a sterile condition until the container is subsequently filled.

Still another object of the invention is to provide a unique coupler which normally connects the fitting permanently to the container but which, if desired, may be released to permit removal and replacement of the fitting.

These and other objects and advantages of the invention will become more apparent from the following detailed description when taken in conjunction with the accompanying drawings.

DETAILED DESCRIPTION OF THE PREFERRED EMBODIMENT

Figure 1:
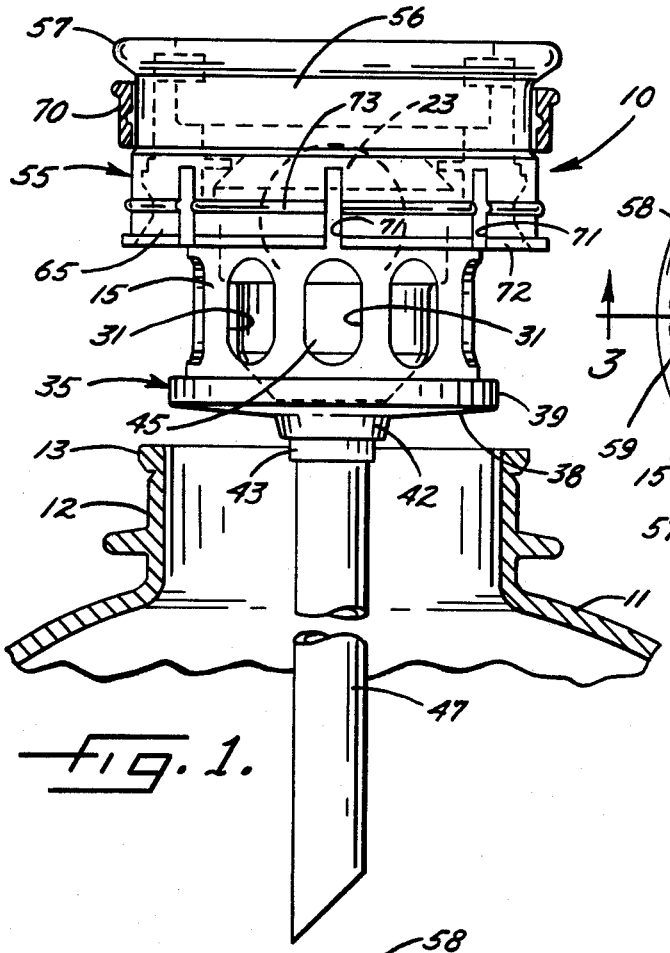
FIG. 1 is a side elevational view illustrating a new and improved fitting incorporating the unique features of the present invention and showing the fitting just prior to installation of the fitting into a container.

For purposes of illustration, the invention is shown in the drawings as being incorporated in a fitting 10 for sealing a container 11 and for enabling liquid to be dispensed from the container. While the container may be made in various sizes and shapes and from various materials, the present container is in the shape of a thirty liter sphere and is blow molded from a preform made of polyethylene terephthalate. The upper end of the sphere 11 is formed with a tubular neck 12 having a radially outwardly projecting peripheral lip 13.

Containers of this type have been marketed for several years by the assignee of the present invention under the trademark BEER SPHERE. While the container was originally developed for draft beer, it will be understood that the container may be filled with wine, soft drinks, other beverages or other liquids. The polyethylene terephthalate sphere itself is sufficiently inexpensive that it can be sold as a disposable, non-returnable container, i.e., a throwaway.

In accordance with the present invention, the fitting 10 is designed for use with popular Sankey-type dispensing taps and is of such low cost construction that it too may be used only once and thrown away with the sphere 11. In large, the low cost construction of the fitting is accomplished through the use of nonmetallic parts, some of which uniquely function as springs.

More specifically, the fitting includes an upright sleeve 15 made of relatively rigid plastic such as nylon and telescoped into the neck 12 of the sphere 11. A groove 16 (FIG. 3) is formed around the outer side of the sleeve and receives an O-ring 17 which seals against the inner side of the neck adjacent the upper end thereof.

An annular web 18 (FIG. 4) is formed integrally with the sleeve 15 within the upper end portion thereof and includes a central circular opening 19 which normally is closed and which, when open, normally permits pressurized gas to be introduced into the sphere 11 to force beer out of the sphere. The web 18 defines an annular valve seat for a valve member 20 which normally closes the opening 19. Herein, the valve member 20 is tubular and includes an upper valve head 21 which preferably is made of rubber and which is formed with a central circular opening 22. The latter is normally closed and, when open, normally permits beer to be dispensed out of the sphere. To close the opening 22, a second valve member which herein is a spherical ball 23 made of Teflon or the like is disposed within the valve head and is adapted to engage an annular valve seat 24 defined by the lower edge of the opening 22.

Figure 4:
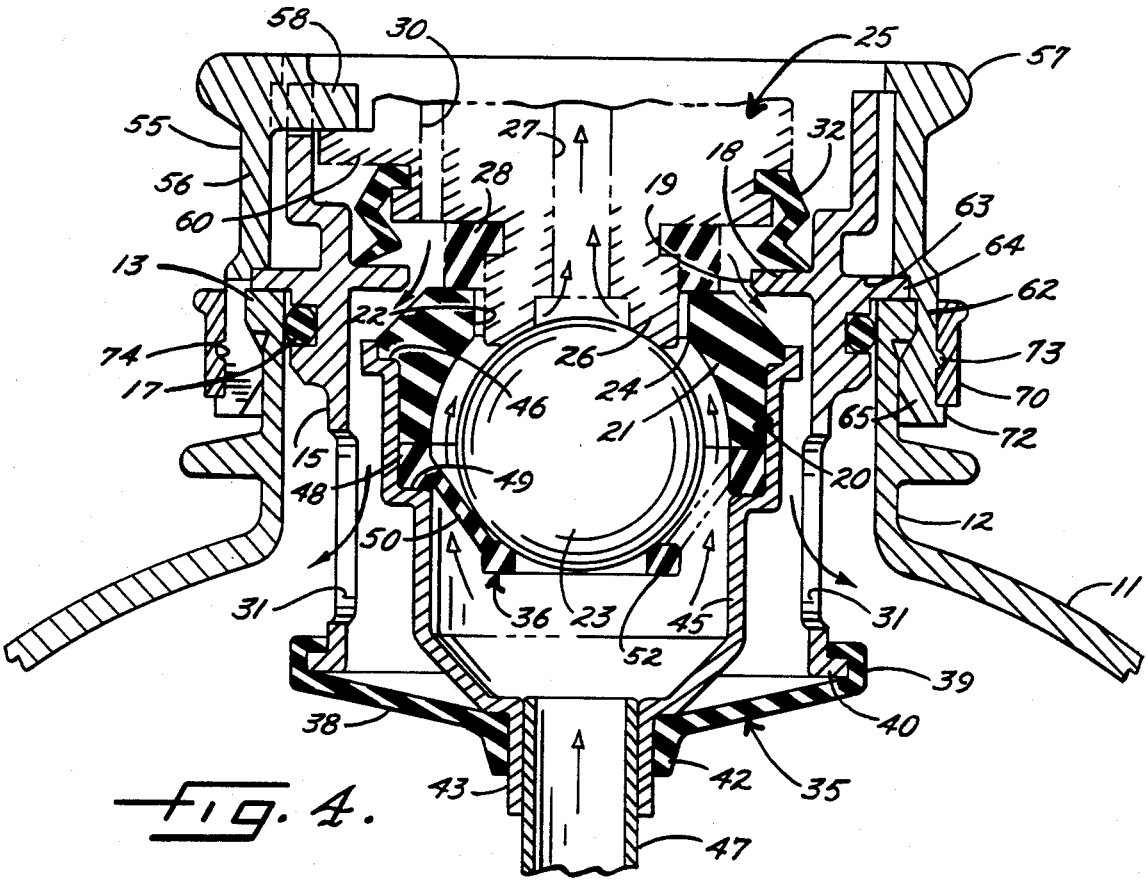
FIG. 4 is a view similar to FIG. 3 but shows certain parts of the fitting shifted to moved positions by a tapping device.

The present fitting 10 is especially designed for use with a Sankey-type tap 25 which has been illustrated somewhat schematically in FIG. 4. Briefly, the tap includes a probe 26 which, when inserted downwardly into the fitting 10 and into the opening 22, engages the ball 23 and forces the ball downwardly away from the seat 24 so that beer may flow upwardly past the ball and through a dispensing passage 27 in the tap. Just shortly after the probe 26 depresses the ball 23, an annular sealing gasket 28 on the probe engages the valve head 21 and forces the latter downwardly away from the valve seat 18 to unseal the opening 19. As a result, pressurized gas (e.g., air or CO2) delivered through a passage 30 in the tap may flow into the sleeve 15 through the opening 19. The pressurized gas flows out of the sleeve through a number of angularly spaced holes 31 in the side wall thereof and flows into the sphere 11 to force the beer out of the sphere, past the ball 23 and into the passage 27. A bellows-type seal 32 (FIG. 4) on the lower end portion of the tap 25 seals against the upper side of the web 18 to prevent beer from spewing past the tap until such time as the gasket 28 seats and seals fully against the valve head 21.

When the tap 25 is withdrawn from the fitting 10, the valve head 21 of the valve member 20 springs upwardly against the seat 18 to close off the opening 19 and, at the same time, the ball 23 springs upwardly against the valve seat 24 to close off the opening 22. In carrying out the present invention, one and preferably both of the valve members 20 and 23 are biased upwardly by relatively inexpensive elastomeric springs 35 and 36 which also serve to hold certain components of the fitting in assembled relationship. The use of the elastomeric springs 35 and 36 helps reduce the manufacturing cost of the fitting sufficiently that the fitting can be sold and used as a disposable component and can be thrown away with the sphere 11.

Specifically, the elastomeric spring 35 is in the form of an annulus or cap made of approximately 90 durometer rubber or similar material. The spring includes a circular disc portion 38 which extends beneath and closes off the lower end of the sleeve 15. Formed integrally with the periphery of the disc is an upwardly and inwardly projecting skirt 39 which hooks resiliently around a radially outwardly projecting flange 40 formed on the lower end of the sleeve 15. The skirt 39 is adapted to be snapped over the flange 40 and keeps the spring 35 securely attached to the sleeve 15.

Figure 3:
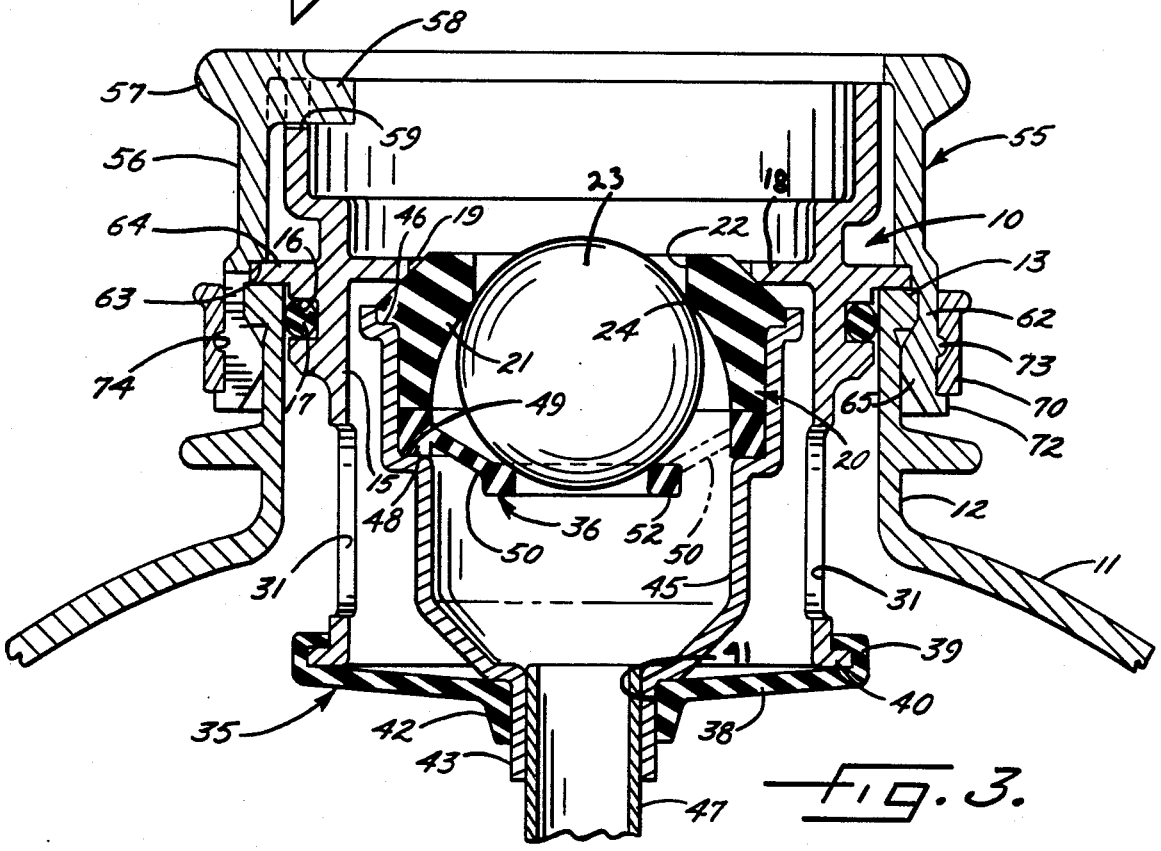
FIG. 3 is an enlarged fragmentary cross-section taken substantially along the line 3—3 of FIG. 2 and shows the fitting installed in the container.

A central hole 41 is formed through the center of the disc 38 of the spring 35 and is encircled by a downwardly projecting collar 42 which is formed integrally with the disc. The collar snugly receives and grips a tubular stem 43 formed integrally with and projecting downwardly from a tubular housing 45 disposed within the sleeve 15. The housing is made of nylon or other relatively rigid plastic and forms part of the tubular valve member 20. As shown in FIG. 3, the housing 45 is formed with an upper internal shoulder 46 which supports the valve head 21 of the valve member 20.

Thus, the elastomeric spring 35 is captivated on the lower end of the sleeve 15 and supports the valve housing 45 of the valve member 20 in a centered position in the sleeve. When the valve head 21 is pushed downwardly by the gasket 28, the elastomeric spring 35 yields and allows the valve head to move downwardly away from the valve seat 18. When the tap 25 is withdrawn from the fitting 10, the elastomeric spring 35 acts against the lower end of the housing 45 to urge the valve head 21 upwardly into sealing engagement with the seat 18.

Secured tightly within the stem 43 of the housing 45 is an elongated draw tube 47 made of high density polyethylene or the like. The draw tube extends downwardly almost to the bottom of the sphere 11 and permits beer from the sphere to flow upwardly into the housing 45 for dispensing through the tap 25. When the valve head 21 is depressed by the gasket 28, the draw tube moves downwardly a short distance with the housing 45 and then springs back upwardly with the housing when the tap 25 is withdrawn.

Figure 5:
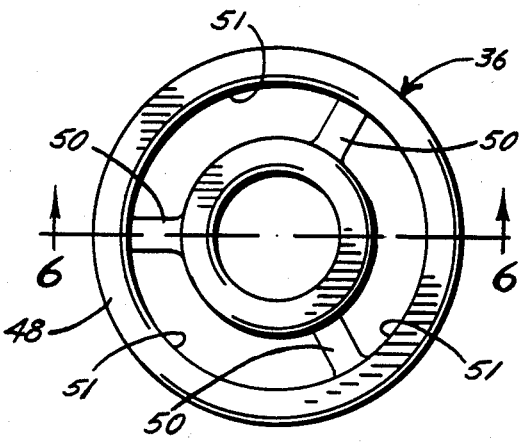
FIG. 5 is a top plan view of one of the elastomeric spring members of the fitting.
Figure 6:
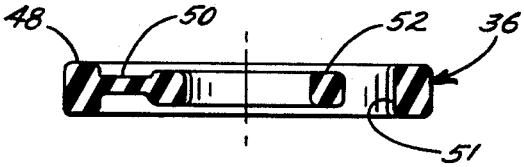
FIG. 6 is a cross-section taken along the line 6—6 of FIG. 5.

The second elastomeric spring 36 is in the form of an annulus or spider made of approximately 70 durometer rubber. The spring 36 includes an outer ring 48 (FIGS. 4 to 6) which is sandwiched and captivated between the lower end of the valve head 21 and a radially inwardly extending annular shoulder 49 formed within the housing 45 below the shoulder 46, the ring being received in the housing with a press fit. Formed integrally with and extending inwardly from the ring are three webs 50 which are spaced angularly from one another so that three flow passages 51 (FIG. 5) are defined between the webs. The webs slope downwardly as they progress inwardly (see FIG. 3) and their inner ends are formed integrally with an inner ring-like piece 52 which defines a cradle or seat for the lower end of the ball 23.

Normally, the spring 36 holds the ball 23 upwardly against the valve seat 24 as shown in FIG. 3. When the probe 26 engages and depresses the ball, the webs 50 stretch yieldably and allow the ball to move downwardly to its open position shown in FIG. 4. Beer flows upwardly through the passages 51 and past the ball to the probe. Upon withdrawal of the probe, the stretched webs 50 contract to snap the ball back upwardly to its closed position. Thus, the elastomeric spring 36 both supports the ball and braces the ball to its closed position.

From the foregoing, it will be apparent that the use of the elastomeric springs 35 and 36 avoids the need for relatively expensive stainless steel springs. In addition, the springs act to hold the housing 45 in assembled relation with the sleeve 15 and to hold the ball 23 in assembled relation with the housing and the valve head 21. As a result, the overall cost of manufacturing the fitting 10 is significantly reduced and thus the fitting may be incorporated in the sphere 11 so inexpensively that the overall package may be sold and used as a disposable, throw-away item. Accordingly, breweries may avoid the expense otherwise incurred in the return and cleaning of conventional kegs.

In accordance with another aspect of the invention, provision is made of a unique coupler 55 which holds the fitting 10 securely in the sphere 11 and which, at the same time, enables the popular and widely used Sankey-type taps to be attached to the sphere. While the coupler is intended primarily to lock the fitting permanently in the sphere and prevent removal of the fitting by a user, the coupler does enable a brewery to remove the fitting in the event the fitting is used in conjunction with a returnable container and ultimately requires repair or replacement.

Figure 2:
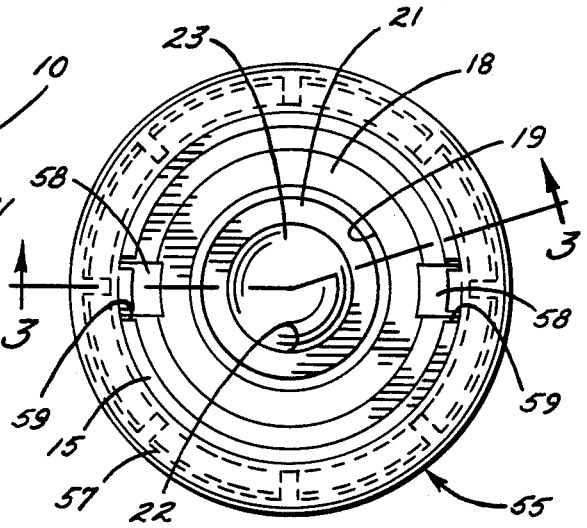
FIG. 2 is a top plan view of the fitting.

In the present instance, the coupler 55 is in the form of a tubular member which is made of resiliently yieldable plastic such as Selcon M 90 and which, in some respects, resembles a so-called Barnes neck. Thus, the coupler includes a generally cylindrical sleeve portion 56 (FIG. 3) whose upper end is formed with a radially outwardly projecting peripheral lip 57. Formed integrally with and projecting radially inwardly from the upper end of the sleeve portion are two diametrically spaced lugs 58 (FIGS. 2 and 3). The lugs snap into notches 59 in the extreme upper end of the sleeve 15 to hold the sleeve and coupler 55 in assembled relation during shipment of the fitting 10 and until such time as the fitting is installed in the sphere 11. In addition, the lugs coact with the locking cam 60 (FIG. 4) of a conventional Sankey-type tap 25 to enable the tap to be securely attached to the coupler. Reference may be made to Brown U.S. Pat. No. 4,520,954 for a more detailed disclosure of a tap with a Sankey-type locking cam. In addition to enabling the use of such a tap, the coupler permits the use of a tap of the type disclosed in Stenger U.S. application Ser. No. 729,304, filed May 1, 1985, entitled Beverage Tap and assigned to the assignee of the present invention. A tap of the latter type locks beneath the lip 57 of the coupler and does not rely on the lugs 58.

Formed integrally with and depending from the lower end of the sleeve portion 56 of the coupler 55 is an annular skirt 62 (FIGS. 3 and 4) which is adapted to telescope snugly over the neck 12 of the sphere 11. The upper end portion of the skirt is formed with an internal shoulder 63 which is adapted to overlie a radially outwardly projecting flange 64 on the sleeve 15 in order to hold the flange against the upper side of the lip 13 of the neck 12. The lower end portion of the skirt is formed with a radially inwardly projecting shoulder 65 which is adapted to hook beneath the lower side of the lip 13.

The fitting 10 is installed by positioning the fitting above the sphere 11 as shown in FIG. 1 and then by moving the fitting downwardly to cause the sleeve 15 to telescope into the neck 12. As an incident thereto, the shoulder 65 of the skirt 62 cams past the lip 13 and then snaps inwardly beneath the lip as the flange 64 comes into engagement with the upper side of the lip. To lock the fitting securely and substantially permanently in its installed position, provision is made of a retaining ring 70 formed from high density polyethylene or other similar relatively rigid but resiliently yieldable plastic. Prior to installation of the fitting, the retaining ring is located in a raised released position as shown in FIG. 1 and encircles the sleeve portion 56 of the coupler 55. After the fitting 10 has been telescoped with the neck 12, the retaining ring is slid downwardly to a locked position shown in FIG. 3. As an incident thereto, the ring cams over the skirt 62 and squeezes the skirt radially inwardly to cause the shoulder 65 to lock securely beneath the lip 13. At the same time, the shoulder 63 is drawn downwardly against the flange 64 to clamp the latter tightly against the upper side of the lip 13 and maintain the seal established by virtue of the O-ring 17 engaging the inner side of the neck 12. To facilitate inward squeezing of the skirt 65, several angularly spaced and downwardly opening slots 71 (FIG. 1) are formed in the skirt to enable the skirt to flex and grip in a manner similar to a collet when the retaining ring 70 is slid downwardly to its locked position. The slots 71 also impart sufficient flexibility to the skirt to enable the retaining ring 70 to be forced upwardly onto and past the skirt from the bottom thereof prior to installation of the fitting 10 into the sphere 11.

When the retaining ring 70 is in its locked position, its lower end abuts an outwardly projecting flange 72 formed around the lower end of the skirt 65. The retaining ring is held securely in its locked position by virtue of an annular rib 73 on the outer side of the skirt snapping into a groove 74 formed around the inner side of the ring. Thus, the rib and the groove define detents which coact with one another to hold the ring securely in its locked position and thereby lock the fitting 10 tightly in its installed position. The locking action of the rib within the groove holds the ring sufficiently that it is not possible to shift the ring upwardly to its released position without exerting considerable force on the ring. Thus, the ring prevents the user from removing the fitting but does enable a brewery to easily install the fitting and also to remove the fitting for repair or replacement if the fitting is used with a returnable container.

Those familiar with the art will appreciate that the fitting 10 also facilitates cleaning and filling of the sphere 11. After the sphere has been blow molded, the fitting is installed and then a sterilizing fluid may be injected into the sphere through the opening 22 and the draw tube 47. The sterilizing fluid drains from the sphere by way of the openings 31 and 19 in the sleeve 15 and, after such draining, the valves 21 and 23 close and seal the sphere and maintain the sphere in a sterile condition for filling. The sphere may be filled by injecting beer through the openings 19 and 31 in the sleeve 15 and by permitting gas in the sphere to escape by way of the draw tube 47 and the opening 22.

I claim:

1. A fitting for a container and comprising an upright sleeve, a first annular valve seat on the upper end portion of said sleeve and defining a first opening for a flow of fluid, an upright tubular valve member disposed within said sleeve and adapted to move upwardly into engagement with said first valve seat to close said first opening, a second annular valve seat on the upper end portion of said tubular valve member and defining a second opening for a separate flow of fluid, a second valve member disposed within said tubular valve member and adapted to move upwardly into engagement with said second valve seat to close said second opening, first resiliently yieldable means acting between said sleeve and said tubular valve member and urging the latter upwardly to a position closing said first opening, second resiliently yieldable means acting between said tubular valve member and said second valve member and urging the latter upwardly to a position closing said second opening, each of said resiliently yieldable means comprising an annulus made of resiliently flexible elastomeric material.

2. A fitting as defined in claim 1 in which said first resiliently yieldable means comprises a disc made of resiliently flexible elastomeric material and having a hole in the center thereof, said disc being attached to the lower end portion of said sleeve and bearing against the lower end portion of said tubular valve member.

3. A fitting as defined in claim 1 in which said second resiliently yieldable means comprises a spider made of resiliently flexible elastomeric material and formed with angularly spaced passages, said spider being disposed within and connected to said tubular valve member and bearing against the lower end of said second valve member.

4. A fitting as defined in claim 1 in which said first resiliently yieldable means comprises a disc made of resiliently flexible elastomeric material and having a hole in the center thereof, said disc being attached to the lower end portion of said sleeve and bearing against the lower end portion of said tubular valve member, said second resiliently yieldable means comprising a spider made of resiliently flexible elastomeric material and formed with angularly spaced passages, said spider being disposed within and connected to said tubular valve member and bearing against the lower end of said second valve member.

5. A fitting as defined in claim 2 in which the lower end portion of said tubular valve member is formed with a downwardly projecting stem which is telescoped with the hole in said disc, said fitting further including an elongated draw tube which is telescoped with said stem.

6. A fitting as defined in claim 5 in which said stem is telescoped snugly into said hole and in which said draw tube is telescoped snugly into said stem.

7. A fitting as defined in claim 3 in which said tubular valve member comprises a lower housing having a radially inwardly extending annular shoulder and further comprises a separately formed valve head telescoped into said housing and formed with said second valve seat, said spider comprising an outer ring sandwiched and captivated between said shoulder and the lower end of said valve head, said spider further comprising an inner piece supporting the lower end of said second valve member, and angularly spaced webs formed integrally with and extending radially between said outer ring and said inner piece, said passages being defined by the spaces between said webs.

8. A fitting as defined in claim 7 in which said second valve member is a spherical ball, said inner piece of said spider comprising a circular ring defining a seat for the lower end of said ball.

9. A fitting for a container and comprising an upright sleeve, a first annular valve seat on the upper end portion of said sleeve and defining a first opening for a first flow of fluid, an upright tubular valve member disposed within said sleeve and adapted to move upwardly into engagement with said first valve seat to close said first opening, a disc made of resilient flexible elastomeric material, said disc being connected to the lower end portion of said sleeve and bearing upwardly against the lower end portion of said tubular valve member to urge the latter to a position closing said first opening, a second annular valve seat on the upper end portion of said tubular valve member and defining a second opening for a second flow of fluid, a second valve member disposed within said tubular valve member and adapted to move upwardly into engagement with said second valve seat to close said second opening, a spider made of resiliently flexible elastomeric material and formed with angularly spaced flow passages, said spider being supported within said tubular valve member between the upper and lower ends thereof and acting between said tubular valve member and said second valve member to urge the latter upwardly to a position closing said second opening.

10. A fitting as defined in claim 9 in which said sleeve is formed with holes communicating with said first opening to permit said first flow of fluid when said tubular valve member is open, and means extending through said disc and communicating with said second opening by way of said tubular valve member and said passages to permit said second flow of fluid when said second valve member is open.

11. A fitting as defined in claim 9 in which a radially outwardly projecting flange is formed on the lower end of said sleeve, said disc being formed with an upwardly and inwardly projecting peripheral skirt which is hooked around said flange to connect said disc to said sleeve.

12. A fitting as defined in claim 11 in which said disc is formed with a central hole, said tubular valve member being formed with a reduced diameter and downwardly projecting stem which extends into said hole in sealing engagement with said disc.

13. A fitting as defined in claim 12 in which said tubular valve member comprises a lower housing having a radially inwardly extending annular shoulder and further comprises a separately formed valve head telescoped into said housing and formed with said second valve seat, said spider comprising an outer ring sandwiched and captivated between said shoulder and the lower end of said valve head, said spider further comprising an inner piece supporting the lower end of said second valve member, and angularly spaced webs formed integrally with and extending radially between said outer ring and said inner piece, said passages being defined by the spaces between said webs.

14. A fitting as defined in claim 13 in which said second valve member is a spherical ball, said inner piece of said spider comprising a circular ring defining a seat for the lower end of said ball.

15. A fitting for a container having an upright tubular neck with a radially outwardly projecting peripheral lip, said fitting comprising an upright sleeve sized to telescope into and seal against said neck, said sleeve being formed with a radially outwardly projecting annular flange positioned to lie against the upper side of said lip, angularly spaced notches in the upper end of said sleeve, valve means within said fitting and operable to control the flow of fluid through the fitting, and a coupler for connecting said fitting to said neck, said coupler comprising an upright tubular member made of resiliently yieldable material and having a lower skirt sized to telescope over said neck, the upper end portion of said tubular member being formed with a radially outwardly projecting peripheral lip and with radially inwardly projecting and angularly spaced lugs, said lugs being received in said notches to hold said tubular member and said sleeve in assembled relation, upper and lower shoulders on said skirt and positioned to engage the upper side of said flange and the lower side of said lip, respectively, and a retaining ring movable upwardly and downwardly on said tubular member between released and locked positions, said retaining ring being operable when moved to said locked position to flex said skirt radially inwardly to cause said lower shoulder to be held in locking engagement with the lower side of said lip and to cause said flange to be clamped between said upper shoulder and the upper side of said lip.

16. A fitting as defined in claim 15 further including detents on the outer side of said tubular member and on the inner side of said retaining ring and engageable with one another to hold said retaining ring securely but releasably in said locked position.

17. A fitting as defined in claim 15 in which several angularly spaced and downardly opening slots are formed through said skirt.

18. A fitting as defined in claim 15 in which a first annular valve seat is formed on the upper end portion of said sleeve and defines a first opening for a flow of fuid, said valve means including an upright tubular valve member disposed within said sleeve and adapted to move upwardly into engagement with said first valve seat to close said first opening, a second annular valve seat on the upper end portion of said tubular valve member and defining a second opening for a separate flow of fluid, said valve means further including a second valve member disposed within said tubular valve member and adapted to move upwardly into engagement with said second valve seat to close said second opening, first resiliently yieldable means acting between said sleeve and said tubular valve member and urging the latter upwardly to a position closing said first opening, second resiliently yieldable means acting between said tubular valve member and said second valve member and urging the latter upwardly to a position closing said second opening, and at least one of said resiliently yieldable means comprising an annulus made of resiliently flexible elastomeric material.

* * * * *